US010905188B2

(12) United States Patent
Jamison

(10) Patent No.: US 10,905,188 B2
(45) Date of Patent: Feb. 2, 2021

(54) PLEXUS OF FILAMENTS WITH LINKED MEMBERS

(71) Applicant: Bradford C. Jamison, Warrensburg, NY (US)

(72) Inventor: Bradford C. Jamison, Warrensburg, NY (US)

( * ) Notice: Subject to any disclaimer, the term of this patent is extended or adjusted under 35 U.S.C. 154(b) by 260 days.

(21) Appl. No.: 15/644,762

(22) Filed: Jul. 8, 2017

(65) Prior Publication Data

US 2018/0020762 A1 Jan. 25, 2018

Related U.S. Application Data

(60) Provisional application No. 62/364,058, filed on Jul. 19, 2016.

(51) Int. Cl.
*A43B 1/04* (2006.01)
*A43B 23/02* (2006.01)
(Continued)

(52) U.S. Cl.
CPC ..... *A43B 1/04* (2013.01); *A43B 23/0205* (2013.01); *A43B 23/042* (2013.01); *D04C 1/02* (2013.01);
(Continued)

(58) Field of Classification Search
CPC ... A43B 1/04; A43B 23/02025; A43B 23/042; D04C 1/02; D04C 1/10; D03D 13/032; D10B 2501/043
See application file for complete search history.

(56) References Cited

U.S. PATENT DOCUMENTS 1,730,263 A * 10/1929 Brooks ..... D03D 19/00 139/419
1,842,692 A * 1/1932 Leighton ..... D03D 9/00 442/203
1,961,961 A * 6/1934 Coldwell ..... D03D 15/08 139/421
(Continued)

OTHER PUBLICATIONS

"Technically Engineered Fabrics (TEF) Website," [www.tefbraids.com], 2010.
"Enter Play Sports Website," [www.enterplaysports.com/], 2008.

*Primary Examiner* — Kevin R Kruer
(74) *Attorney, Agent, or Firm* — Birch Tree IP Law and Strategy PLLC.; Jamie T. Gallagher

(57) ABSTRACT

Disclosed herein is a plexus of filaments which is composed of paired filaments which travel extensively around one another to form a double helix structure, where each pair of filaments belongs to a group of filaments, traverse at crossing angles to other filaments which belong to at least another group of filaments, thus repetitively crossing the paths of the filament pairs in at least another group of filaments. Also defined within the specifications and claims herein is the linking of the filaments between the different paired groups of filaments, which facilitates the distribution of tension between the filaments within a plexus of filaments. Herein described are plexuses which exhibit greater conformal and constrictive qualities in comparison to the prior art. Also disclosed is a method of producing filament structures for a variety of uses including composite structures, with enhanced structural properties, including but not limited to; tension displacement properties, for use in applications requiring conformal load distribution with minimal weight.

13 Claims, 10 Drawing Sheets

(51) Int. Cl.

| | |
|---|---|
| ***A43B 23/04*** | (2006.01) |
| ***D04C 1/10*** | (2006.01) |
| ***D04C 1/02*** | (2006.01) |
| ***D03D 13/00*** | (2006.01) |

(52) U.S. Cl.
CPC ..... *D04C 1/10* (2013.01); *D03D 13/002* (2013.01); *D10B 2501/043* (2013.01)

(56) References Cited

U.S. PATENT DOCUMENTS 1,965,248 A * 7/1934 Moore ..... D03D 15/08 139/423
2,312,226 A * 2/1943 Woodward ..... D03D 15/08 139/419
2,338,945 A * 1/1944 Jan ..... D04B 21/00 66/195
2,359,591 A * 10/1944 Staines ..... D03D 15/0077 139/391
2,541,231 A * 2/1951 Fligg ..... D03D 11/00 139/413
2,742,060 A * 4/1956 Moberg ..... D03C 7/00 139/419
2,924,251 A * 2/1960 Nowicki ..... D03D 27/06 139/403
2,981,139 A * 4/1961 Sutter ..... D04C 5/02 87/4
2,981,297 A * 4/1961 Rogers ..... D03C 7/00 139/391
3,249,128 A * 5/1966 Wilfrid ..... D03D 1/0094 139/419
3,279,504 A * 10/1966 Wagner ..... D03C 7/00 139/419
3,298,274 A * 1/1967 Oswald ..... D04C 3/00 87/24
3,335,763 A * 8/1967 Bellmore ..... D03D 23/00 139/419
3,395,738 A * 8/1968 Rhodes ..... D03D 5/00 139/385
3,446,251 A * 5/1969 Dow ..... D03D 9/00 139/383 R
3,709,090 A * 1/1973 Gruenberg ..... D04G 3/02 87/4
3,874,422 A * 4/1975 Dow ..... D03D 13/002 139/383 R
4,186,499 A * 2/1980 Massok, Jr. ..... A43B 17/102 139/420 R
4,328,840 A * 5/1982 Fontana ..... D03D 19/00 139/419
4,671,841 A * 6/1987 Stephens ..... B32B 3/12 156/292
4,862,925 A * 9/1989 Motta ..... D03C 7/06 139/50
4,870,887 A * 10/1989 Tresslar ..... B29C 53/68 87/9
5,067,384 A * 11/1991 Scala ..... D07B 5/005 87/6
5,085,253 A * 2/1992 Motta ..... D03C 7/06 139/419
5,092,727 A * 3/1992 Moghe ..... B29C 53/585 411/411
5,111,760 A * 5/1992 Garzone, Jr. ..... D06Q 1/005 112/439
5,337,647 A * 8/1994 Roberts ..... D04C 3/04 87/31
5,357,839 A * 10/1994 Brookstein ..... D04C 1/06 87/1
5,388,498 A * 2/1995 Dent ..... D04C 1/06 87/50
5,697,969 A * 12/1997 Schmitt ..... A61F 2/06 600/36
5,899,134 A * 5/1999 Klein ..... D04C 1/02 87/13
5,950,457 A * 9/1999 Wagner, Jr. ..... D04B 21/14 442/314
5,979,288 A * 11/1999 Gallagher ..... D04C 1/06 57/10
6,000,442 A * 12/1999 Busgen ..... D03D 3/08 139/100
6,184,161 B1 * 2/2001 Verpoest ..... B29C 70/16 427/209
6,323,145 B1 * 11/2001 Popper ..... B32B 5/024 442/366
6,389,851 B1 * 5/2002 Groshens ..... D04B 21/14 66/192
6,477,865 B1 * 11/2002 Matsumoto ..... D04B 21/10 66/195
6,630,414 B1 * 10/2003 Matsumoto ..... A47C 31/006 442/1
7,332,049 B2 * 2/2008 Blanton ..... B29C 70/546 156/245
7,364,587 B2 * 4/2008 Dong ..... D04C 1/06 623/1.5
7,523,693 B1 * 4/2009 Engelhart ..... F41H 5/0464 109/49.5
7,828,019 B2 * 11/2010 Shen ..... D03D 11/00 139/383 R
7,938,853 B2 * 5/2011 Chouinard ..... D04C 3/48 623/1.15
8,202,396 B2 * 6/2012 Hultcrantz ..... D21F 1/0027 162/116
8,850,692 B2 * 10/2014 Han ..... B26D 1/0006 29/700
8,858,857 B2 * 10/2014 Wood ..... D04C 1/06 264/265
8,859,088 B2 * 10/2014 Broughton, Jr. ..... D04C 1/06 428/221
8,943,941 B2 * 2/2015 Dow ..... D04C 1/06 87/11
9,078,658 B2 * 7/2015 Hewitt ..... A61B 17/12177
2002/0022875 A1 * 2/2002 Strecker ..... A61F 2/90 623/1.15
2002/0053157 A1 * 5/2002 Safwat ..... A01K 73/02 43/9.1
2002/0157429 A1 * 10/2002 Matsumoto ..... D04B 21/10 66/195
2004/0237599 A1 * 12/2004 Kondou ..... D04B 15/48 66/202
2006/0058862 A1 * 3/2006 Dong ..... D04C 1/06 623/1.5
2006/0081013 A1 * 4/2006 Gross ..... D04B 1/16 66/64
2007/0106370 A1 * 5/2007 Chouinard ..... D04C 1/06 623/1.15
2007/0144221 A1 * 6/2007 Sytz ..... D04B 1/18 66/171
2007/0272385 A1 * 11/2007 Quigley ..... D21F 11/006 162/267
2013/0102217 A1 * 4/2013 Jeon ..... D03D 15/00 442/182
2013/0105029 A1 * 5/2013 Hannes ..... D03C 19/00 139/11
2013/0305465 A1 * 11/2013 Siegismund ..... D04C 1/06 12/146 C
2014/0373389 A1 * 12/2014 Bruce ..... A43B 23/0295 36/87
2014/0377488 A1 * 12/2014 Jamison ..... A43B 1/04 428/36.1
2015/0007451 A1 * 1/2015 Bruce ..... D04C 1/06 36/83
2015/0201707 A1 * 7/2015 Bruce ..... A43B 23/04 36/47
2015/0352306 A1 * 12/2015 Scheiner ..... A61M 16/0875 128/205.25
2016/0000155 A1 * 1/2016 Marecek ..... A41D 1/08 2/228

* cited by examiner

PLEXUS OF FILAMENTS WITH LINKED MEMBERS

CROSS-REFERENCE TO RELATED APPLICATIONS

This application claim priority from U.S. Provisional Patent Application 62/364,058 filed on Jul. 19, 2016, the disclosures of which are included by reference herein in their entirety.

BACKGROUND OF THE INVENTION

Technical Field

The present invention generally relates to a plexus of strands, or braided filaments, threads, yarns etc., and the processes and apparatus for forming plexuses, or fabrics from yarns, filaments or strands, by interlacing and linking filaments or strands, to produce fabrics and/or products produced from filament plexuses. The present invention more specifically relates to unique patterns that can be produced on machines that can be programmed to produce a unified plexus of filaments; for use in any number of applications; whether those applications utilize the fabrics with, or without a matrix, such as a polymer, to form a composite structure.

As an untreated "dry" plexus of fibers, the patterned filaments could be utilized within a variety of products including apparel, medical, and sporting goods. The multi-axial filament networks described herein, are comprised of linked and interlaced filaments, threads or yarns, although, plexuses may also be produced from single strand filaments such as monofilament thread, wire, or the like. Dry applications of the current invention provide improvements to prior art filament plexuses due to the distributive nature of the tension placed on filaments when patterned, as describe herein. The patterned plexus of filaments described herein, provides for material which would have enhanced flexibility and conformability. As such, the endurance of such a plexus is likely to be increased due to the balance of tension placed on all the fibers within the plexus, particularly when plexuses are used in applications such as footwear uppers, where; excessive tension and subsequent wear may be located in one area of a plexus of filaments, such as around the ball of a foot. The invention herein described allows for excess tension to be displaced throughout a plexus of filaments, subsequently limiting excessive wear to the plexus, and adding comfort for the wearer by limiting excessive pressure points on a person's body. The same limiting of excessive pressure on areas of the body is also facilitated when the present invention is used in other body wear such as bras and underwear.

When the plexus of filaments, as described in the present invention, is used in conjunction with a matrix, to form a composite structure, improved functionality is inherent to the patterned plexus due to the more conformable nature of the plexus, as well as the stability of the of individual filaments within the plexus, thus making the present invention easier to "layup" (combine with a matrix) over irregular shapes. Improved structural qualities are also inherent to the current invention when combined with a matrix to form a composite structure. During this process, the fibers, within the fully and equally distributive plexus described herein, provide for uniform displacement of filaments around mandrels or shaping tools that may comprise complex shapes. This is largely due to the non-rigid, actively changeable relationship between each of the fibers that make up the herein described plexus of fibers. The qualities of a composite fiber structure may vary dependent upon the desired qualities for any particular application. One such application example being the tail portion of an oversized badminton "Bird" wherein flexibility and impact resistance are amongst the qualities desired. After a plexus of fibrous material has been embedded into a matrix, and the matrix is cured to a rigid, semi-rigid, or flexible state, structural improvements are apparent and include increased impact strength, which is due, in part, to the increased inability of individual filaments or yarns to delaminate from other filaments within the plexus of filaments since all or some of the filaments within the structure partially wrap; wrap halfway around another filament, thus forming a "link" between two filaments, as opposed to filaments only overlapping, as is practiced in standard braided material. Standard braided filament structures, particularly when formed over mandrels with varying shapes and geometries, will exhibit an inherent weakness where filaments overlap, intersect or bisect, due to fiber delimitation, wherein impact and repeated stresses can cause layers to separate. The inventor has found the delimitation of fibers to be an inherent weakness when using standard prior art filaments structures in composite structures, in particular, when the braided fabric is exposed to repetitive impacts as a badminton shuttle or the like would be.

Description of Related Art

The practice of weaving, braiding, and knitting yarns and/or threads has a long history. The basic concept of interlacing fibers, typically at right angles, has origins in pre-recorded history. Through the centuries, fiber weaving, braiding, and knitting machines and methods have developed and continue to develop wherein, the practices and techniques employed in the production of apparel and countless other products have become varied and refined in order to produce specialty goods and products to fulfill specific functions and appearances, for use in a endless variety of applications and products.

Definitions of weaving and braiding: Weaving and braiding are generally described as the practice of interlacing strands or fibers together into a singular, unified plexus of filaments. The braiding process may be defined as the interlacement of filaments around a radial axis, whereas weaving is generally defined as the interlacement of filaments along two perpendicular angles. Both weaving and braiding interlace fibers by repetitively having fibers traveling in one axial direction, pass both above and below fibers; traveling in another opposed axial direction. Both weaving and braiding can also include filaments traveling in a third axial direction. This third axial direction generally lies in the center, between the two opposed axial directions, thus, filaments traveling in either opposed axial direction, will cross the paths, by intersecting or bisecting the filaments traveling in the third axial direction; at generally the same relative angle. Both weaving and braiding can produce the same fundamental patterns with filaments and yarns. The primary difference between the two practices can be expressed by how one or the other is produced, or upon what type of machine is producing the pattern to which the fibers follow. Weaving, or weaving machines typically utilize an opposed biaxial filament arrangement, which extends primarily flat; along the zero and ninety degree axis of a plane: Historically this process of interlacing fibers along these two axes is what would define weaving; although other fibers or elements may be introduced along other axes, to produce a tri-axial weave, or other type of specially woven material. Variations in weaving techniques start with how many yarns a particular yarn crosses before it changes, from traveling on top of other yarns, to below other yarns. Braiding, in comparison, has historically been accomplished by interweaving yarns around a central or "polar" axis. Although the end product may be fundamentally the same as a weave, the means of achieving those ends are quite different. While weaving intertwines yarns along the zero and ninety degree axes, within a generally planer area of space; the space unto which a typical braiding machine braids fibers is fundamentally cylindrical, insomuch that braided yarns are interlaced along a circular path, thus the ability for braiding machines to create tubular plexuses of material.

Advances in technology and advances in the use of that technology continue to develop in the fields of composite technology and fiber technology. The present inventor has recognized that within the field of braiding technology there have been few advances regarding the basic types of constructions unto which braids are produced. This has generally been due to the limitations of standard braiding machines currently utilized in the marketplace. In fact, most braiding machines are only capable of producing standard biaxial braids. A smaller number of braiding machines are also able to produce tri-axial braids by introducing an additional set of static yarns to an otherwise, standard braiding machine. The additional static yarns are typically drawn from spools below the braiding surface of a machine, and introduced into the braided plexus through holes, located at a center point between where the carriers cross paths as they carry spools of yarn in opposite directions around a primarily circular path; upon the surface of a machine. When a third set of static filaments is drawn into a plexus between where the carriers cross paths, the static yarn becomes sandwiched between the yarns traveling around the surface of a machine. Thus, the static yarns become integrated into the braided plexus as a whole; as a third lateral.

A Lace Braiding Machine; which is best defined as a programmable braiding machine, fundamentally functions the same way as a standard, automated braiding machine, insomuch as with both machines, carriers are directed to travel in undulating circular paths around the surface of the machine, and the spools of yarn held by the carriers pass by one another as they travel in opposite directions around the planer surface of a machine. The undulations in the paths to which braiding machine's carriers direct spools of yarn to travel, is what allows the spools of yarn to cross paths, insomuch that the paths of the undulations for the carriers, set in one direction, is offset from the paths to which the carriers follow traveling in the opposite direction. Therefore, when a carrier traveling in one direction is at its low point within its circular undulating path, the carrier traveling in the other direction is at its high point within its undulating path, and the spools of yarns are able to pass in front of or behind the other spools of yarn, relative to the center of the circular path in which they ostensibly travel. Unlike a standard braiding machine wherein all the carriers must follow a set path around the surface of the machine, a lace braiding machine's carriers are programmable to follow an undulating path around a radial axis of a machine, not to travel at all, or just to travel in circles, ostensibly remaining in one place while other carriers travel past or around it. This ability, which sets a lace braiding machine apart from a standard braiding machine, is what allows for an infinite number of patterned networks of fibers to be produce upon a programmable, or "lace braiding machine."

As recognized by the present inventor, conventional means of weaving and braiding of yarns, threads, and other filamentous material can yield less than ideal products, especially due to the non-conforming nature of woven and braided material, which typically relies on friction and filament proximities to retain filament network uniformity. Prior art weaves and braids typically have a dense filament structure, where the close proximity of other filaments within the structure is what primarily keeps the filaments or strands of filaments from becoming displaced within the network of filaments. It is, in part, the dense filament structure that inhibits conformity of prior art fabrics, around irregular or complex shapes.

Another limitation in prior art weaves and braids is due to the primarily linear, taunt nature of the filaments within a plexus. Typically, woven and braided fabrics are made up of two perpendicular groups of parallel filaments, wherein the filaments from one group are interwoven with the filaments in the opposed group. The filaments in an interwoven braid or weave follow a primarily straight path that waves up and down as filaments cross above and below filaments extending in an opposed direction. The primarily straight path that the two groups of yarns traverse, and which makes up a braid or weave, constrains a fabric's ability to elongate or misshape the material into which the fibers are woven or braided. This limitation is significant in comparison to the present invention, whose filaments are linked together, and extend along paths which more closely resemble a Z. This zigzag path increases a plexus of fibers' ability to elongate in any direction; thus greatly increasing the material's ability to conform to irregular shapes. Another limitation of weaves and braids is their ability to absorb impact, insomuch that woven filaments, function primarily as singular filaments, and not as a coefficient unified plexus; which is to say that displacing one strand within a plexus is possible without transferring that displacement force throughout the plexus, i.e. one strand could be pulled from a weave or braid without significantly pulling, or tensioning any other strands within the plexus. The fact that the filaments in prior art weaves and braids act as individuals and not as a coefficient plexus can lend excessive stresses to individual filaments. Another drawback in prior art filament structures is filament displacement; since filaments in either axial group are not interconnected (linked) to other filaments in their respective groups, it is easy to displace filaments, or groups of filaments, within the plexus of filaments, particularly if the plexus is loosely woven or braided; as it is sometimes desired.

In regard to structural composite applications, an advantage the herein disclosed invention has over prior art, lies within the function of the double helix, which is a part of the basic structure of the pattern herein disclosed. A double helix may be defined as a pair of parallel helices intertwined about a common axis. A double helix structure within composite material functions as a three-dimensional truss, insomuch that such twisted fibers lie in tension against each other, or, from another point of view, lean against each other, thus potentially doubling each other's strength in comparison to single parallel filaments as found in conventional weaves and braids.

Aspects of the present invention also address the disadvantages and limitations of a broad range of article design and construction, including, but not limited to, furniture, sporting goods, apparel, accessories, protective gear, and fiber-reinforced composite structures, including, tubes, rods, bars, plates, and sheets, among other structures and structural components.

SUMMARY OF THE INVENTION

Aspects and details of the present invention, comprise filament arrangements, plexuses, or structures, methods of fabricating filament arrangements or structures, and articles having one or more filament arrangements, for example: a plurality of filaments which are networked in such a way, as to produce a singular unitary structure or length of material, which would be useful in accessories, sporting goods, bags, containers, protective clothing, and the like. In one application of the present invention, the filament structures disclosed herein can provide a structural framework unto which a matrix, such a rigid or flexible foam material may be molded around. In another application of the present invention, the plexus of filaments may be produced from monofilament wire such as copper, and used to transmit electrical or other energy or sound waves. And, as a dry plexus of filaments, the present invention is useful in conforming to and supporting human body parts such as feet and breasts.

Aspects of the present invention provide filament structures and articles made from filament structures, for example, clothing, furniture, rope, wire and cable, and sporting goods, having improved performance compared to the prior art. For example, the filament structures disclosed herein may provide greater flexibility, greater endurance, and greater conformability than prior art filament structures. Aspects of the present invention provide for enhanced distribution of loading, for example, pressure placed on a single yarn within the present invention, has the ability to transfer that pressure throughout the plexus of fibers. Thus the plexus of fibers as described by the present invention, has increased abilities to absorb impacts and equally distribute and conform to pressures, in comparison to prior art.

The present invention is defined as a plexus of filaments. The plexus may be produced from pre-braided filament bundles, such as cordage, or twisted filament bundles such as threads or yarns, or parallel bundles of continuous or non-continuous filament, known in the composite industry as a "tow" of fiber, or the plexus may be produced from single filament structures such as wire, or strands of leather. The present invention is further qualified as being comprised of pairs of fundamentally helical filaments, or "double helices" as defined by DNA structures. The present invention consists of at least two pairs of helical filaments, which traverse in opposed intersecting angles, and create links with each member in the opposed traveling pair or pairs of filaments. The term linking will refer to the process of one or more strands or filaments traveling halfway around or partially wrapping another filament. To rephrase; the present invention can be defined as at least two groups of filaments whose members not only cross the paths of the opposed group of filaments, but are also linked to the filaments within pairs of filaments which belong to an opposed group of pairs of filaments.

Regarding a method of creating a plexus of filaments on a programmable machine, wherein the machine would have a planer or tubular surface upon which carriers would travel; in a programmed, direction and extent, at defined intervals. Disposed upon the carriers would be spools of filaments, from which the filaments would be drawn. Filaments could also be drawn through a hole in the surface of a machine from large spools located beneath or behind the surface upon which the carriers travel. The pre-programmed, patterned movements of the carriers, by the machine, while filaments are being drawn from spools, allow for the creation of a plexus of filaments as described as the present invention. The method to create a patterned plexus of filaments upon a machine would be to program the machine to direct carriers to cross in front and behind other carriers, subsequently interlacing or linking other filaments. More specifically, the method to create a patterned plexus of filaments, as herein described, on a programmable machine; would be to program pairs of carriers, to cross paths repetitively while traveling in one direction around the surface of a machine, and have programmed another set of pairs of carriers to travel in the other direction around the surface of a machine, while each member in each pair of filaments repetitively cross each other, thus creating pairs of overlapping and underlapping zigzagging filaments traveling in different directions upon the surface of a machine, and; wherein the filaments within the pairs of filaments are linked to filaments traversing in the opposite direction by traveling halfway around each other and then continue traveling in opposite directions around the machine. Also, the pairs of carriers traveling in opposed directions, cross the paths of other pairs of carriers, thus interlacing the pairs of filaments as they travel above and below individual filaments within the pairs of filaments traveling in different axial directions.

It is beneficial to note for the sake of clarity, that if the carriers traveled along extensively circular paths around the surface of a machine, such as a circular lace braiding machine, and the paths to which groups of carriers extensively traveled were clockwise and counterclockwise, the paths would continuously bisect each other around a radial axis, and form a tubular plexus of filaments. Alternatively, if the paths of the carriers traveled around a machine were all directed to stop at a defined location and change directions continuing the same pattern but in the opposed direction to which they were traveling, a plexus of filaments would be formed that was not tubular, and whose filament members traveled back and forth between either side of what would be considered a flat tape or fabric. Also noteworthy, with regard to programmable circular lace braiding machines, would be the ability to program the paths to which the carriers travel around a machine, to be continuous and discontinuous, which is to say; not travel all the way around the machine for a period of time and reverse direction, continuing a pattern of linking and interlacing filaments around only a portion of the machine, and then return to a pattern of going all the way around a machine, thus creating a hole along the length of a substantially tubular plexus of filaments.

Another note with regard to programmable circular braiding machines is the ability to have groups of carriers which travel in three bisecting directions; a first direction being clockwise, a second direction being counterclockwise, and a third direction being longitudinal or stationary; unto which the other two groups would bisect. Subsequently, the present invention could also be produced by programming paired filaments in each of the three axial groups to be linked with filaments within each of the other groups of filaments, and each of the pairs of filaments would also be programmed to interlace with the filaments in the other groups, thus creating a trilateral group of linked and interlaced filaments. Another way of creating a trilateral plexus of filaments would be to have three groups of filaments; again, one going clockwise, a second going counterclockwise, and a third group which, instead of being drawn from spools located on carriers, would be drawn from the underside of the surface upon which the carriers travel; in between the points where carriers cross paths. This configuration would effectively allow additional filaments to become linked and interlaced with the other two filament groups. An advantage to drawing filaments through openings in the surface of the machine to which carriers travel, would be the ability to increase the number of filaments a given machine could draw into a plexus.

Another aspect of the invention lies within the method unto which a plexus is formed, and the paths to which filaments travel throughout the plexus, those filament paths being specifically definable as to produce a double helix structure with the filaments which are pulled from spools, freely attached to spool carriers. The spiraling double helix described herein, is formed by having two yarns which repetitively overlap each other by crossing paths first on top, or in front of, and then below or behind the other strand, dependent upon one's vantage point. The repetition of this pattern of crossing paths essentially twists the two strands around one another. While the pairs of yarns are twisted around one another, they, as a pair of yarns, also follow a spiraling path around the circumference of a cylindrical plexus of filaments, unless however, the plexus of filaments was patterned to create a non-tubular plexus, in which case, the yarn pairs of helical filaments would together spiral, first, a portion of the way around a cylindrical plexus, and then change directions and spiral back in the opposite direction around the plexus, basically following a path back and forth between either side of a discontinuous cylindrical plexus of filaments.

An end use of a plexus of filaments as described herein, would be the production of a human body resting devise, wherein the invention would be produced as a tubular or flat plexus of filaments, and would then be tensioned around a frame. The advantage of such a device would be not only to provide a breathable mesh, but also to equally distribute the load from pressure points, which engage the material, which would then improve circulation at typical pressure points on a human body while at rest.

Aspects of the present invention may be applied to a broad range of industries and technologies. For example, another end use for material produced by the present invention would include apparel and accessories, which could be produced at least partially, from one or more of the fiber arrangement disclosed herein. Another use would be in the production of wires and/or cables having one or more of the fiber arrangements disclosed herein, and to which could exhibit enhanced strength, sound dampening, vibration dampening, and/or energy transfer compared to prior art wires and cables. Ropes and cordage could also be produced utilizing the fiber arrangements disclosed herein, which would have enhanced flexibility, extendibility (stretch), and/or strength compared to prior art ropes and cordage. Fiber-reinforced structures and composite materials could be produced with the fiber arrangements disclosed herein, which would exhibit enhanced structural qualities such as, tension or compression strength as well as flexile strength.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following description of aspects of the invention taken in conjunction with the accompanying drawings in which:

DETAILED DESCRIPTION OF DRAWINGS

Figure 1:
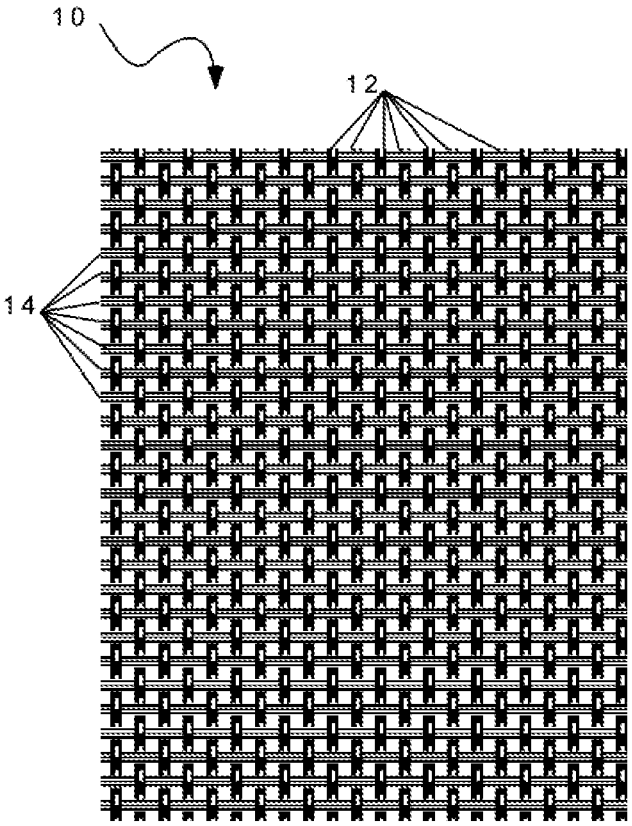
Figure 1 Prior Art
FIG. 1 is a schematic illustration of a weave according to the prior art.

FIG. 1 is a schematic illustration of woven filaments 10, as described by prior art. As shown in FIG. 1, and as is typical of woven filament structures, weave pattern 10 typically includes a series or plurality of longitudinal or vertical "warp" filaments 12 traversing along the zero degree axis which perpendicularly engage with a plurality of lateral or horizontal "weft" filaments 14 which traverse along the 90 degree axis. As shown, warp filaments 12 "interlace"; cross in front and behind; weft filaments 14, for example, the patterned behavior of the filaments is to first pass over a filament and then under the next filament, and repeat this patterned process with a plurality of regularly spaced perpendicular filaments. As know in the art, the close proximity of the warp filaments 12 and weft filaments 14, is what provides the structural integrity, or integration of the fibers into one plexus of material 10; primarily through the friction between the warp 12, and weft 14 filaments.

Figure 2:
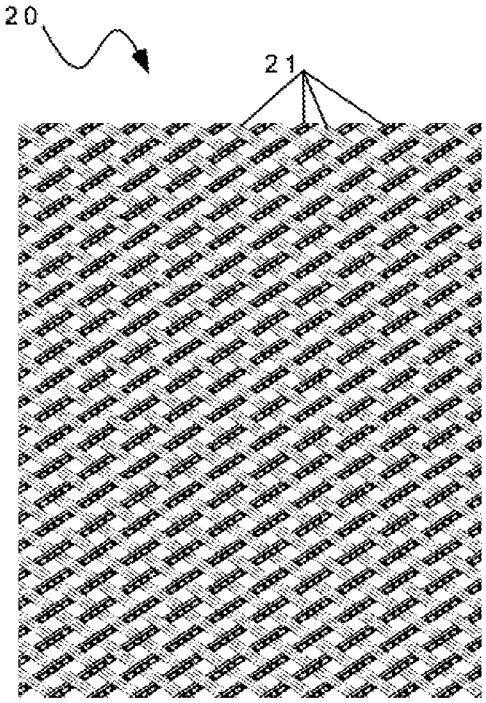
Figure 2 Prior Art
FIG. 2 is a schematic illustration of a braid according to the prior art.

FIG. 2 is a schematic illustration of a braided filaments 20, as described by prior art. The patterned filaments shown in FIG. 2, depict a typically patterned braid 20, which includes a plurality of three or more filaments 21, which are interlaced; traverse repetitively above and below opposed crossing filaments, at regularly spaced intervals, to typically form an elongated tubular plexus of filaments, although flat, non tubular material may also be produced by disallowing the carriers holding spools of filaments from following a complete circular path around the circumference of the table upon which they are directed, thus forcing the carriers to double back in the opposite direction, thereby creating a partially tubular plexus of filaments that will readily lay flat. In distinction from the weave pattern 10 shown in FIG. 1, in braid pattern 20, the filaments 21 typically "interlace" with each other repeatedly at regularly spaced intervals, along the 45 degree axis. As known in the art, the engagement of the filaments 21, through friction created from the contact between the filaments, provides the structural integrity of the braid pattern 20.

Figure 3:
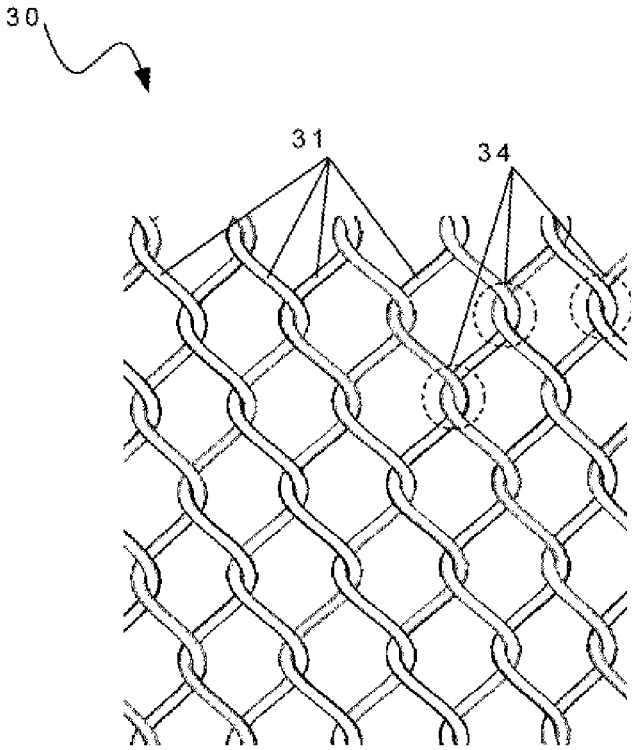
Figure 3 Prior Art
FIG. 3 is a plan view of a portion of a typical chain-link fence having "linked" members according to the prior art.

FIG. 3 is a plan view of a portion 30 of a typical chain-link fence having "linked" members or wires 31 as described by prior art. FIG. 3 shows that adjacent wires are linked 34 together repetitively at regular spaced intervals. Each link is created by two members of fence portion 30 which partially wrap around each other creating a link 34 between the wires 31. The wrap between two wires could be described as a half wrap, as each wire contacts the other around half of their circumference. As known in the art, the engagement of the wires 31 at the "links" 34, provides the structural integrity of the wire fence portion 30.

Figure 4:
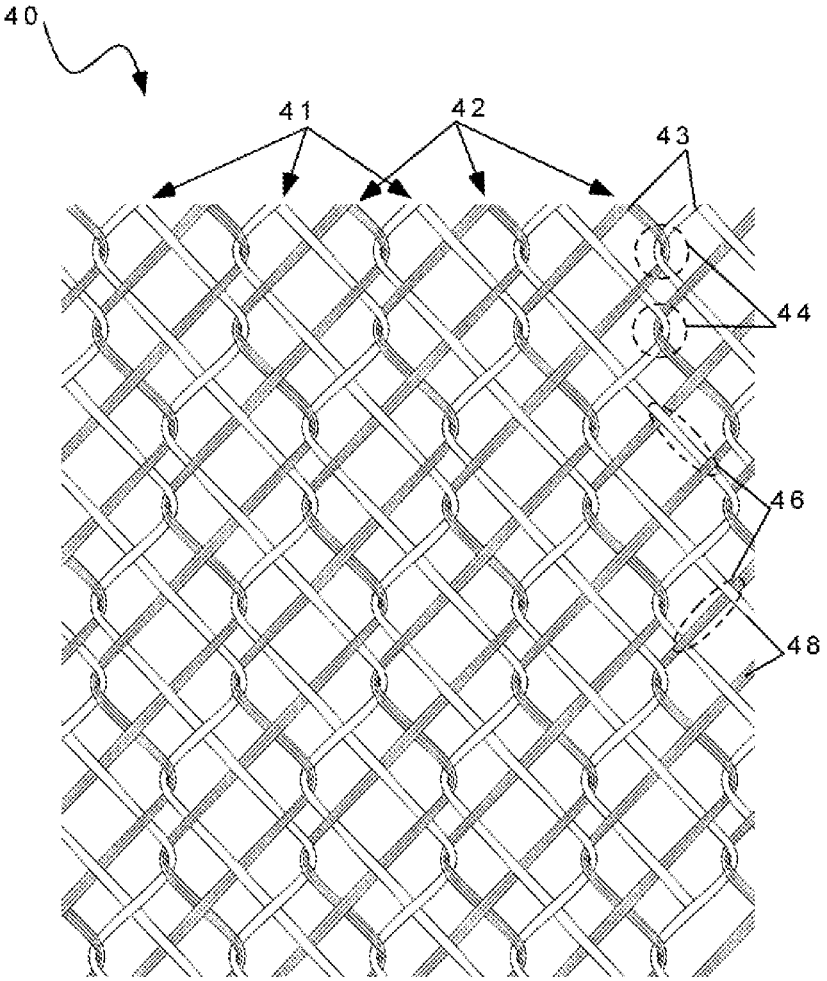
FIG. 4 is a plan view of a patterned plexus of filaments which has two groupings of a multiplicity of paired double helical filaments, wherein each grouping of paired filaments traverse along opposed intersecting angles, and wherein the filaments from each grouping of paired filaments link to, and are interlaced with, the opposing group of filaments, according to one aspect of the present invention.

FIG. 4 is a plan view of the an aspect of the current invention 40 having two opposed groups of filaments, 41 & 42 consisting of paired filaments 43, wherein each member in each pair of filaments 43 twist around one another along their lengths, ostensibly forming a double helical filament structure. The paired filaments 43 contain filament members 48 which twist around one another along their lengths, by traveling, and crossing first on one side of each other and then crossing each other on the antithetical side, and in so repeating this pattern, twist around one another. FIG. 4 also shows that each of the filaments 48, in each of the pairs of filaments 43, link 44 to all of the filaments in the oppositely traversing group of paired filaments. FIG. 4 also shows that each filament in each of the pairs of filaments create a link 44 with oppositely traversing filaments, and that each filament also becomes interlaced 46 with all of the filaments in the opposing group of filaments, by traversing on top of an underneath filaments belonging to the opposing group of filaments.

Figure 5:
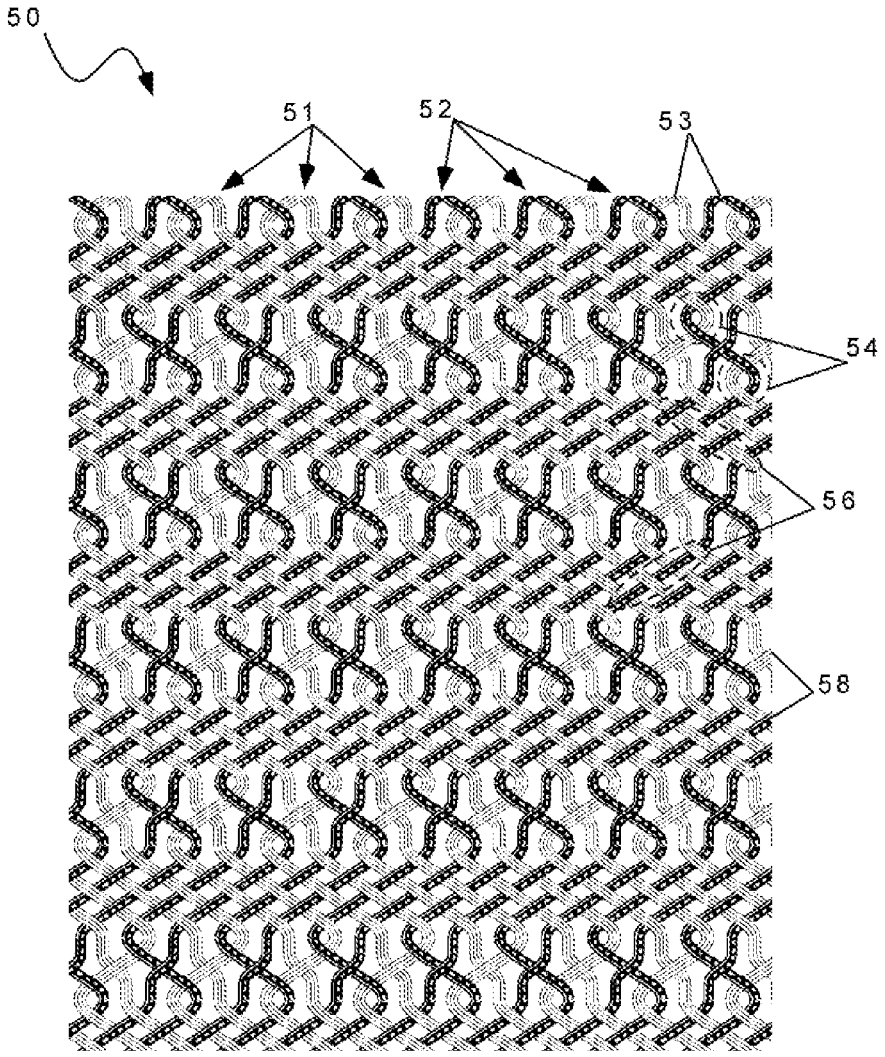
FIG. 5 is a plan view of a patterned plexus of filaments which has two groupings of a multiplicity of paired helical filaments or paired filaments traversing in overlapping zigzag paths, wherein each grouping of paired filaments traverse along opposed bisecting axial angles, and wherein the filaments from each grouping of paired filaments link to, and are interlaced with, the opposing group of filaments; according to one aspect of the present invention.

FIG. 5 is a plan view of the an aspect of the current invention 50 having two opposed groups of filaments, 51 & 52 consisting of paired filaments 53, wherein member in each pair of filaments 53 twist around one another along their lengths, ostensibly forming a double helical filament structure. The paired filaments 53 contain filament members 58 which twist around one another along their lengths, by traveling, and crossing first on one side of each other and then crossing each other on the antithetical side, and in so repeating this pattern, twist around one another. FIG. 5 also shows that each of the filaments 58, in each of the pairs of filaments 53, link 54 to all of the filaments in the oppositely traversing group of paired filaments. FIG. 5 also shows that each member in each of the pairs of filaments create a link 54 with oppositely traversing filaments, and each filament also becomes interlaced 56 with all of the filaments in the opposing group of filaments, by traversing on top of an underneath filaments belonging to the opposing group of filaments.

Figure 6:
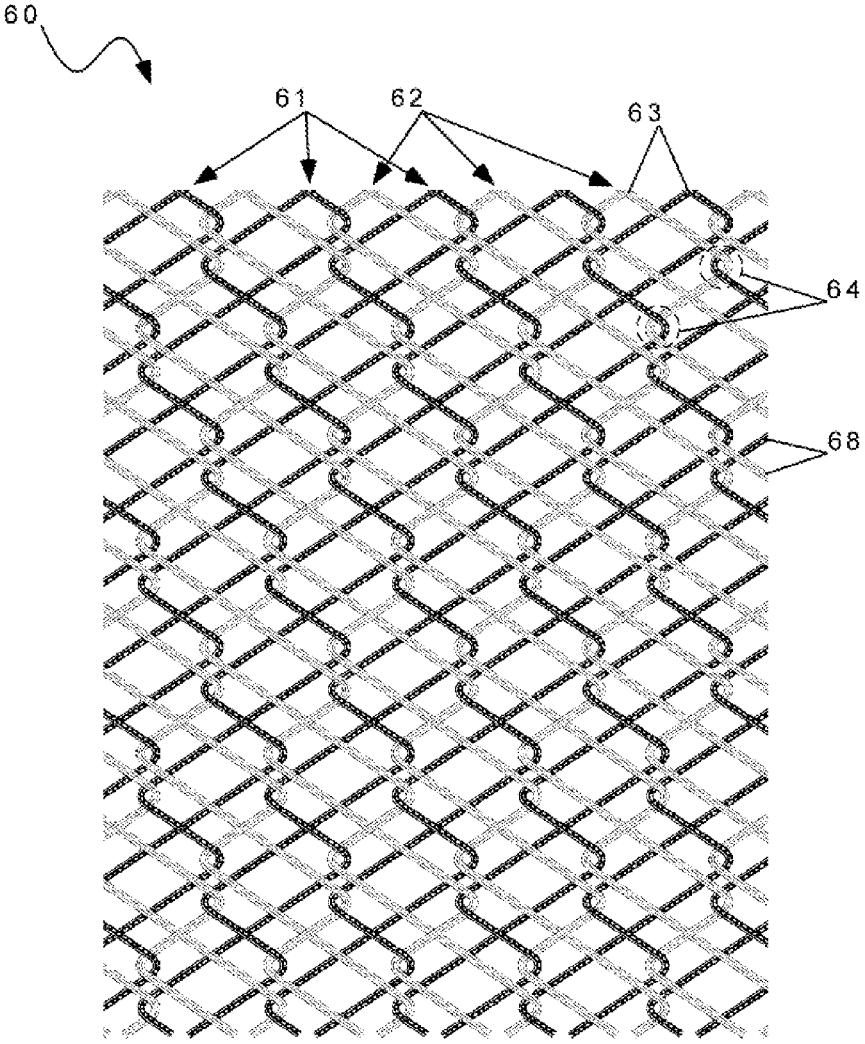
FIG. 6 is a plan view of a patterned plexus of filaments which has two groupings of a multiplicity of paired double helical filaments, wherein each grouping of paired filaments traverse along opposed intersecting angles, and wherein the filaments from each grouping of paired filaments link to the each filament within each pair of filaments within the opposing group of filaments; according to one aspect of the present invention.

FIG. 6 is a plan view of another aspect of the current invention 60 having two opposed groups of filaments, 61 & 62 consisting of paired filaments 63, wherein each member in each pair of filaments 63 traverses in zigzagging paths and each member crosses alternately above and below the other member. The paired filaments 63 twist around one another along their lengths, by having each of the filaments 68 in each of the pairs of filaments 63 travel, and cross each other first on one side, and then cross each other on the antithetical side, and in so repeating this pattern, ostensibly twist around one another. FIG. 6 also shows that each of the filaments 68, in each of the pairs of filaments 63, create links 64 with each of the filaments in the oppositely traversing group of paired filaments. FIG. 6 clearly shows that each member 68 in each of the pairs of filaments 61 & 62 are linked 64 to individual filaments 68 within filament pairs 61 & 62 which traverse in bisecting angles and cross the opposed directional pairs of filaments.

Figure 7:
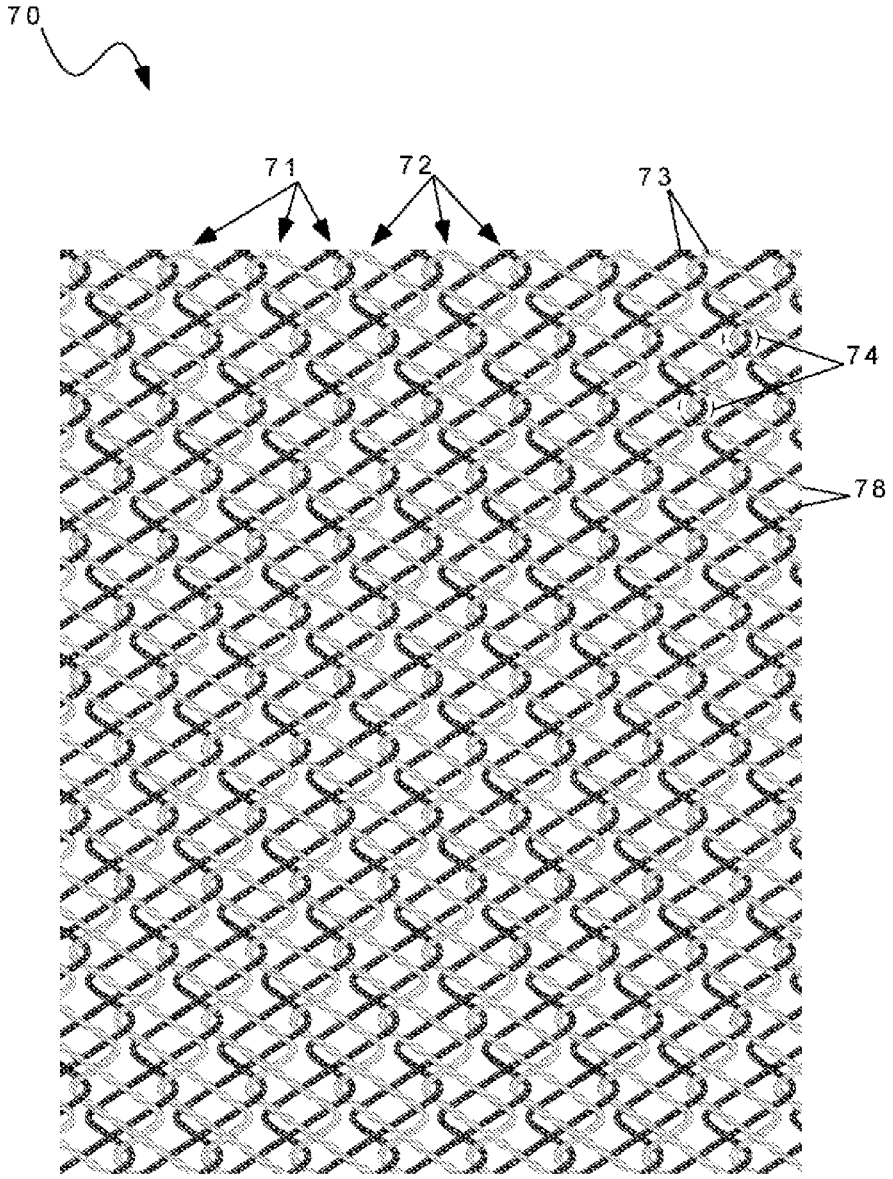
FIG. 7 is a plan view of a patterned plexus of filaments which has two groupings of a multiplicity of paired double helical filaments, wherein, each grouping of paired filaments traverse and cross the paths of the other group of paired filaments, and wherein the filaments from each grouping of paired filaments link to the each filament within each pair of filaments within the opposing group of filaments, according to one aspect of the present invention.

FIG. 7 is a plan view of the an aspect of the current invention 70 having two opposed groups of filaments, 71 & 72 consisting of paired filaments 73, wherein each member in each pair of filaments twist around one another along their lengths, ostensibly forming a double helical filament structure. Each member in the paired filaments 63 twist around one another along their lengths, by traveling, and crossing first on one side of each other and then crossing each other on the antithetical side, and so in repeating this pattern, twist around one another. FIG. 7 also shows that each of the filaments 78, in each of the pairs of filaments 73, link 74 to all of the filaments in the oppositely traversing group of paired filaments.

Figure 8:
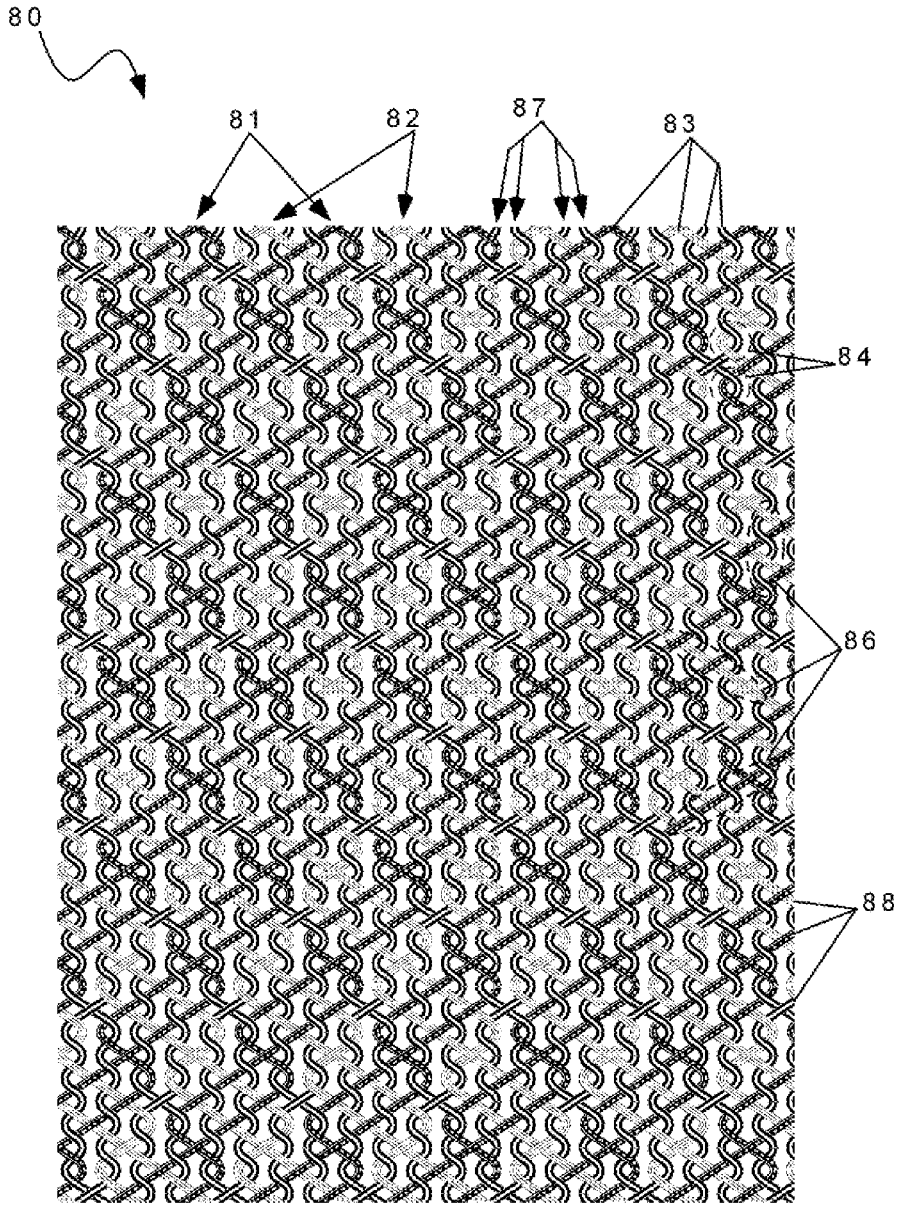
FIG. 8 is a plan view of a patterned plexus of filaments which has three groupings of a multiplicity of paired filaments which traverse in overlapping zigzag or ostensibly elliptical paths and, wherein there are two grouping of paired filaments which traverse along opposed bisecting axial angles, and a third grouping of paired filaments which traverse along the zero degree axis and bisect or cross the filaments within the two opposed groupings of paired filaments, and wherein the filaments from each grouping of paired filaments are interlaced with filaments belonging to other grouping of filaments, and each of the filaments within the grouping of paired filaments, which is centered between the two opposed groupings of paired filaments, creates links with all of the filaments in the two intersecting groupings of paired filaments; according to one aspect of the present invention.

FIG. 8 is a plan view of an aspect of the current invention 80 having three intersecting groups of paired filaments, 81, 82 & 87 consisting of paired filaments 83, wherein each member in each of the pairs of filaments twist around one another along their lengths, ostensibly forming a double helical filament structure. The paired filaments 83 twist around one another along their lengths, by traveling, and crossing first on one side of each other and then crossing each other on the antithetical side, and so in repeating this pattern, twist around one another. FIG. 8 also shows that each of the filaments 88, in each of the pairs of filaments 83, link 84 to each of the filaments in the intersecting groups of paired filaments. FIG. 8 also shows that each filament 88 also becomes interlaced 86 with the filaments in the intersecting groups of filaments, by traversing on top of and underneath filaments belonging to an intersecting group of filaments.

Figure 9:
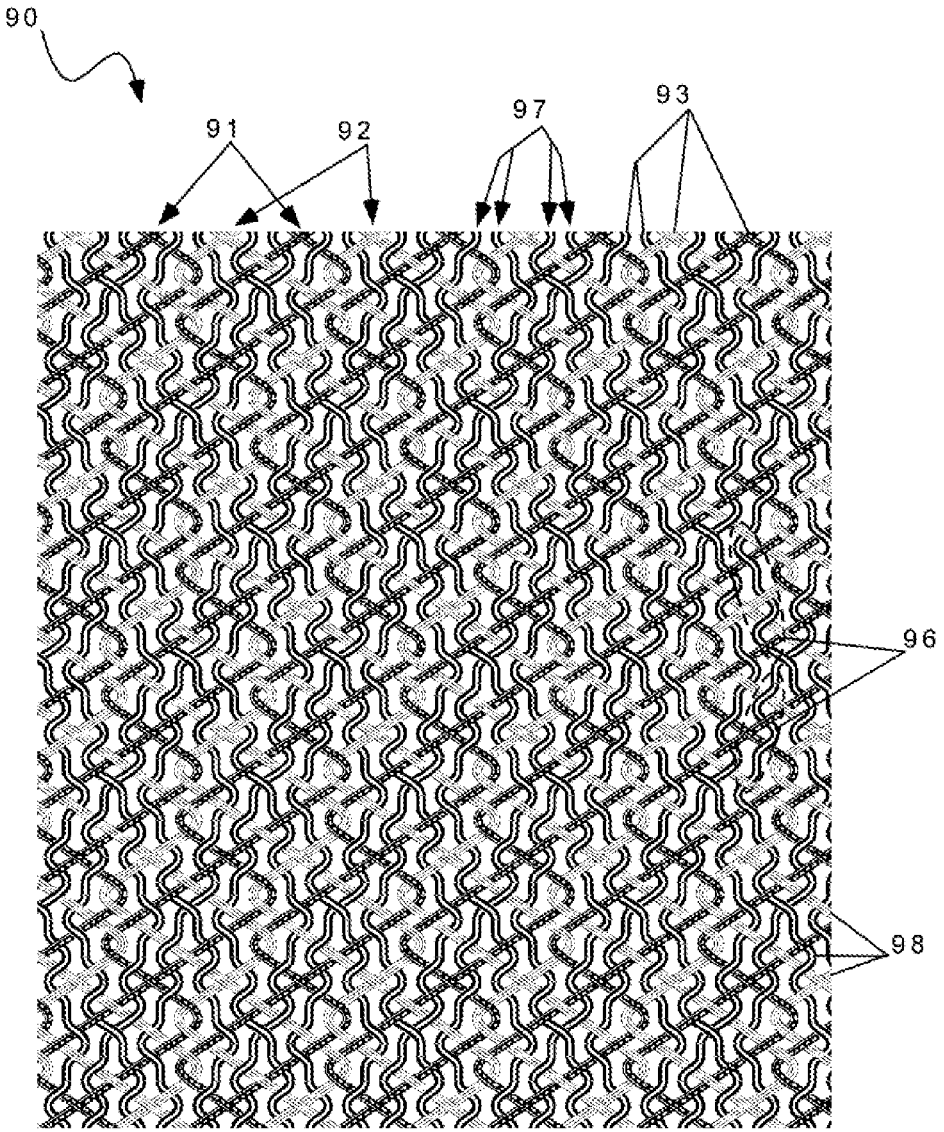
FIG. 9 is a plan view of a patterned plexus of filaments which has three groupings of a multiplicity of paired under and overlapping filaments which traverse in zigzagging paths and, wherein; there are two grouping of paired filaments which traverse along opposed intersecting angles, and a third grouping of paired filaments which traverses at a bisecting axial angle centered between the two opposed axial angles which the other groupings of paired filaments traverse, and wherein, the filaments from each grouping of paired filaments are interlaced with filaments belonging to other grouping of filaments, and, wherein all of the filaments within the grouping of paired filaments which lie at two opposed intersecting angles, create links with all of the filaments within the opposed grouping of paired filaments; according to one aspect of the present invention.

FIG. 9 is a plan view of the an aspect of the current invention 90 having three intersecting groups of paired filaments, 91, 92 & 97 consisting of paired filaments 93, wherein each member in each pair of filaments twist around one another along their lengths, ostensibly forming a double helical filament structure. The paired filaments 93 twist around one another along their lengths, by traveling, and crossing first on one side of each other and then crossing each other on the antithetical side, and so in repeating this pattern, twist around one another. FIG. 9 also shows that each of the filaments 98, in each of the pairs of filaments 93, is interlaced 96 with the filaments in the intersecting groups of paired filaments. FIG. 9 also shows two groups of paired filaments 91 & 92 whose individual members are linked to individual members in the opposed axial grouping of paired filaments.

Figure 10:
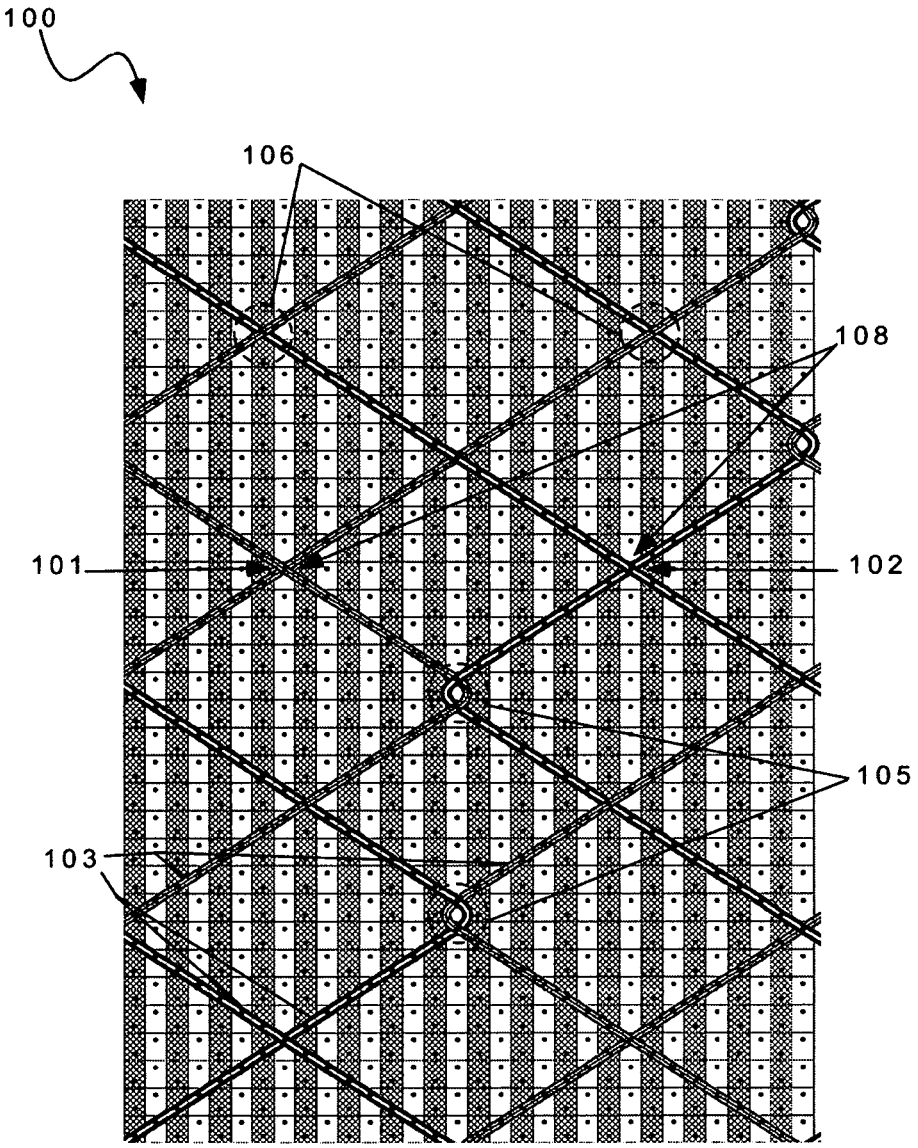
FIG. 10 is a plan view of a patterned plexus of filaments which has two groupings of paired filaments, wherein each individual filament within each pair of filaments traverses in a zigzagging path which crosses above and below the other filament within the pair of filaments, and wherein each filament within the pairs of filaments crosses above and below filaments within the other pair of filaments, repetitively along their lengths.

FIG. 10 is a plan view of the an aspect of the current invention 100 having two opposed groups of filaments, 101 & 102 consisting of paired filaments 108, wherein each member in each pair of filaments 103 twist around one another along their lengths, ostensibly forming a double helical filament structure. The paired filaments 103 contain filament members 108 which twist around one another along their lengths, by traveling, and crossing first on one side of each other and then crossing each other on the antithetical side, and in so repeating this pattern, twist around one another. FIG. 10 also shows that each of the filaments 108, in each of the pairs of filaments 103 create a link 105, with oppositely traversing filaments, and that each filament also becomes interlaced 106 with all of the filaments in the crossing group of filaments, by traversing on top of an underneath filaments belonging to the crossing group of filaments.

I claim:

1. A plexus of filaments, comprising:

a first group of filaments including a first pair of filaments, the first group of filaments as a group generally traversing the plexus in a first path across the plexus;

a second group of filaments including a second pair of filaments, the second group of filaments as a group generally traversing the plexus in a second path across the plexus, the second direction opposing the first direction;

wherein each of the filaments in the first pair of filaments repetitively cross each other along the first path and each of the filaments in the second pair of filaments repetitively cross each other along the second path;

wherein each filament of the first group of filaments links to multiple filaments of the second group of filaments as the first path crosses the second path such that a first filament of the first pair of filaments traverses filaments of the second group of filaments in a first repeating pattern of linking and crossing, the first pattern including the first filament linking at least two filaments of the second group of filaments and crossing multiple filaments of the second group of filaments without linking to the multiple filaments as they are crossed, the first pattern also including the first filament of the first pair of filaments crossing a second filament of the first pair of filaments in between linking a first one of the at least two filaments of the second group of filaments and linking a second one of the at least two filaments of the second group; and wherein filaments of the first group of filaments do not link with other filaments of the first group of filaments as the first path traverses the plexus.

2. A plexus according to claim 1, wherein each filament of the first pair of filaments links to every fifth filament of the second group of filaments as the first path crosses the second path.

3. A plexus according to claim 1, wherein the first pattern includes the first filament linking to a first one of the traversed filaments of the second group of filaments, the first filament linking to the next one of the traversed filaments of the second group of filaments, and the first filament crossing the next four filaments of the traversed filaments of the second group of filaments without linking, the next four filaments of the traversed filaments of the second group of filaments including a first, second, third, and fourth ones of the next four filaments of the traversed filaments of the second group of filaments traversed in order.

4. A plexus according to claim 3, wherein the first pattern includes the first filament crossing the second filament in between crossing the second and third ones of the next four filaments of the traversed filaments of the second group of filaments.

5. A plexus according to claim 4, wherein the first pattern includes the first filament alternately weaving on different sides of filaments as it crosses the next four filaments of the traversed filaments of the second group of filaments and the second filament.

6. A plexus according to claim 4, wherein the first pattern includes the first filament crossing the next four filaments of the traversed filaments of the second group of filaments on a first side of the plexus and crossing the second filament on a side of the plexus opposite of the first side.

7. A plexus according to claim 4, further comprising a third group of filaments, the third group of filaments traversing the plexus such that the filaments of the third group of filaments weave through the filaments of the first and second groups.

8. A plexus according to claim 7, wherein the first pattern includes the first filament crossing multiple filaments of the third group of filaments.

9. A plexus according to claim 1, wherein, the first pattern includes the first filament linking to a first one of the traversed filaments of the second group of filaments, the first filament linking to the next one of the traversed filaments of the second group of filaments, and the first filament crossing the next eight filaments of the traversed filaments of the second group of filaments without linking, the next eight filaments of the traversed filaments of the second group of filaments including a first, second, third, fourth, fifth, sixth, seventh, and eight ones of the next eight filaments of the traversed filaments of the second group of filaments traversed in order.

10. A plexus according to claim 9, wherein the first pattern includes the first filament crossing the second filament in between crossing the fourth and fifth ones of the next eight filaments of the traversed filaments of the second group of filaments.

11. A plexus according to claim 1, wherein the of the second group of filaments, and the first filament crossing the next four filaments of the traversed filaments of the second group of filaments without linking, the next four filaments of the traversed filaments of the second group of filaments including a first, second, third, and fourth ones of the next four filaments of the traversed filaments of the second group of filaments traversed in order.

12. A plexus according to claim 11, wherein the first pattern includes the first filament crossing a second filament of the first pair of filaments in between crossing the second and third ones of the next four filaments of the traversed filaments of the second group of filaments and the first filament crossing the second filament after crossing the fourth one of the next four filaments of the traversed filaments of the second group of filaments.

13. A plexus according to claim 1, further comprising a third group of filaments, the third group of filaments traversing the plexus such that the filaments of the third group of filaments weave through the filaments of the first and second groups.

* * * * *